US006868700B2

(12) United States Patent
Sawa

(10) Patent No.: US 6,868,700 B2
(45) Date of Patent: Mar. 22, 2005

(54) DRY CLEANING MACHINE AND METHOD OF DRY CLEANING

(76) Inventor: Kohei Sawa, c/o Clean Sawa Kabushiki Kaisha, 1-33, Uzu 1-chome, Wakayama-shi, Wakayama 641-0043 (JP)

( * ) Notice: Subject to any disclaimer, the term of this patent is extended or adjusted under 35 U.S.C. 154(b) by 217 days.

(21) Appl. No.: 09/907,043

(22) Filed: Jul. 17, 2001

(65) Prior Publication Data

US 2001/0047553 A1 Dec. 6, 2001

(51) Int. Cl.[7] ..... D06F 33/00

(52) U.S. Cl. ..... 68/12.08; 68/12.13; 68/18 C; 68/207; 134/111; 134/113

(58) Field of Search ..... 8/142, 158, 159; 68/12.08, 12.09, 12.13, 18 R, 18 C, 18 F, 207; 134/109, 110, 111, 112, 113

(56) References Cited

U.S. PATENT DOCUMENTS

| | | | | | |
|---|---|---|---|---|---|
| 3,515,276 | A | | 6/1970 | Comer et al. | 210/26 |
| 4,780,218 | A | | 10/1988 | Kohler | 210/774 |
| 5,518,583 | A | * | 5/1996 | Nykanen et al. | 162/29 |
| 5,534,078 | A | * | 7/1996 | Breunsbach | 134/10 |
| 5,558,841 | A | * | 9/1996 | Nakagawa et al. | 422/105 |
| 5,722,017 | A | * | 2/1998 | Caruthers et al. | 399/238 |
| 5,722,441 | A | * | 3/1998 | Teramoto | 134/56 R |
| 5,768,730 | A | * | 6/1998 | Matsumoto et al. | 8/159 |
| 5,904,737 | A | * | 5/1999 | Preston et al. | 8/158 |
| 5,943,720 | A | | 8/1999 | Chung | 8/158 |
| 6,027,651 | A | | 2/2000 | Cash | 210/662 |
| 6,314,601 | B1 | * | 11/2001 | McClain et al. | 8/158 |

FOREIGN PATENT DOCUMENTS

| | | | | |
|---|---|---|---|---|
| JP | 62121601 A | * | 6/1987 | B01D/3/42 |
| JP | 2001-198394 | | 7/2001 | |

OTHER PUBLICATIONS

Copy of European Search Report of EP 01 117 142 dated Dec. 18, 2001.

* cited by examiner

*Primary Examiner*—Frankie L Stinson
*Assistant Examiner*—Joseph L. Perrin
(74) *Attorney, Agent, or Firm*—Butzel Long

(57) ABSTRACT

The object is to avoid contaminating the washing conversely by contaminated detergent and provide a dry cleaning machine and dry cleaning method, solving hygienic issues.

In a dry cleaning machine which supplies detergent from a detergent tank 11 to a washing tank 10 and washes the washing in the washing tank 10 and treats detergent used in the washing tank 10 by a filtering tank 16 and sends the treated detergent to the washing tank 10 to use detergent cyclically, wherein contaminating the washing conversely by washing can be prevented, as detecting contamination level of detergent discharged from the washing tank 10 while supplying detergent to the washing tank 10 and washing the washing, and when the detergent contamination level reached a prescribed threshold level, storing the detergent discharged from the washing tank 10 temporarily and sending the detergent to a distiller 14 and supplying fresh detergent from the detergent tank 11 to the washing tank 10.

8 Claims, 6 Drawing Sheets

DRY CLEANING MACHINE AND METHOD OF DRY CLEANING

BACKGROUND OF THE INVENTION

1. Field of the Invention

This invention relates to a dry cleaning machine using a solvent as a detergent and preventing contamination of the washing caused conversely by washing.

2. Description of the Related Art

FIG. 5 is showing a constitutional block diagram of a dry cleaning machine by prior art.

In FIG. 5, a drum-formed washing tank 1 is for washing the washing by rotating drum, throwing the washing into the drum tank, supplying a detergent (tetrachloroethylene or the like). The contaminated detergent after using is stored in a lower tank 2. This detergent is sent into a filtering tank 4 and forwarded to a refining tank 5 by a pressure pump 3. In the refining tank 5, the detergent is refined to remove odors, acids and colors with filters, activated carbon and the like and then returned into the drum tank 1 to be reused.

In the dry cleaning machine shown in FIG. 5, washing power of the detergent is remarkably sunk by cyclical use, even though the contaminated detergent is refined in the refining tank. Therefore, in a conventional dry cleaning machine, a detergent collecting unit as shown in FIG. 6 is appended. In this detergent collection unit, the heavy contaminated detergent in the washing tank 1 is sent into a distiller 6. The contaminated detergent in the distiller 6 is heated to vaporize the detergent and other moisture and the vaporized gas is forwarded to a condenser 7. The vaporized gas in the condenser 7 is liquefied by chiller water and is separated to detergent and water through a water separator 8. The detergent is sent to a collection tank 9 and the separated water is sent to a separated water tank 10. The detergent collected in the collection tank 9 is forwarded to the washing tank 1 to be used.

On the other hand, a dry cleaning machine has washing property as shown in FIG. 7. The washing property in FIG. 7 shows phenomena of contaminator dissolving into the detergent and the washing property curve (a) shows contamination is maximized in a short time and is going down slowly after the peak. Thus, in the washing property, the detergent contamination becomes the maximum roughly at one minute and 30 seconds after starting, slightly depending on the washing type or contaminator type. In FIG. 7, the vertical axis indicates detergent contamination and the horizontal axis indicates washing time.

The dry cleaning machine, shown in FIG. 5, uses cyclically refined detergent to send the contaminated detergent through a filtering tank and a refining tank. Owing to the detergent contamination becomes the maximum in a short time, shown in FIG. 7, there is apprehension to contaminate the washing conversely by washing. In addition, the detergent filtering in the filtering tank works well just after the dry cleaning machine running, but, as increasing washing cycle number, some waste threads, dirty oil or other dirt in the detergent stick on a filter and clog up the filter. When clogging up the filter, filtering efficiency is rapidly sinking and a volume of detergent flowing is going down. As washing performance cannot be kept if the volume of detergent flowing goes down, in general, increasing the detergent pressure in the filtering tank to keep the volume of detergent flowing maintains the washing performance of the dry cleaning machine. That, however, cannot solve the issue of contaminating the washing conversely by washing. Furthermore, there is apprehension that increasing detergent pressure in the filtering tank damages the filtering tank or the refining tank easily and then it possibly contaminates the washing by supplying contaminated detergent to the washing tank Even if reusing detergent distilled by the distiller shown in FIG. 6, the detergent contamination becomes the maximum in a short time after washing starting because of no deference on washing property of the dry cleaning machine shown in FIG. 7. There are still issues of contaminating the washing conversely by washing and bad hygiene.

SUMMARY OF THE INVENTION

This invention has been accomplished to overcome the above drawbacks and an object of this invention is to avoid contaminating the washing conversely by contaminated detergent and provide a dry cleaning machine and method of dry cleaning, solving hygienic issues.

In order to attain the objects, according to an aspect of this invention, in a dry cleaning machine including a detergent tank to store detergent, a washing tank and a filtering tank to treat used detergent, wherein the treated detergent is sent back to the washing tank for cyclical use, there is provided the dry cleaning machine comprising of detecting means for detecting contamination level of the detergent discharged from the washing tank while washing, storing means for storing the used detergent when the contamination level of detergent reaches prescribed threshold level and distilling means for distilling the used detergent, whereby fresh detergent is supplied from the detergent tank to the washing tank.

In the dry cleaning machine mentioned above, before the detergent contamination becomes the maximum in a short time from starting washing the washing, the detergent channel is switched from washing tank-to-filtering tank to washing tank-to-contaminated detergent tank. During switching the detergent channel as mentioned above, fresh detergent is supplied to the washing tank and it can solves an issue to contaminate the washing conversely by contaminated detergent.

Advantageously, in the above machine, wherein detecting the contamination level of the detergent in a channel from the filtering tank to the washing tank, when the contamination level indicate an abnormal value, shutting the channel and storing temporarily the detergent from the filtering tank and distilling the detergent by the distiller.

In the machine, when detecting an abnormal value of contamination level of the detergent passed through the filtering tank, the detergent is distilled in the distiller after stored temporarily and reused. Then, rapid clogging up the filtering tank can be solved and cyclically use of the detergent can be worked.

Preferably, a dry cleaning machine, comprising of a washing tank for washing the washing by detergent supplied from a detergent tank, a filtering tank for refining contaminated detergent discharged from the washing tank and supplying the refined detergent to the washing tank, a contamination detector for detecting contamination level of detergent after used in the washing tank, a contaminated detergent tank for storing contaminated detergent temporarily while shutting detergent supplying channel from the washing tank to the filtering tank when the contamination level is over prescribed threshold level, a distiller to distill the contaminated detergent from the contaminated detergent tank and a condenser for condensing vaporized contaminated detergent in the distiller and sending the condensed detergent to the detergent tank.

In the dry cleaning machine mentioned above, by detecting contamination level of the detergent discharged from the washing tank with the contamination detector, the detergent channel from the washing tank to the filtering tank is switched to the contaminated detergent tank and the detergent is stored there, before the detergent contamination becomes the maximum in a short time after starting washing. After that, the contaminated detergent is sent to the distiller and vaporized in the distiller. The vaporized gas is forwarded to the condenser and condensed by chiller water and reused as refined detergent.

Advantageously, the dry cleaning machine mentioned above, wherein the second detector is mounted in a channel to supply detergent from the filtering tank to the washing tank for detecting the detergent contamination level in the channel.

In this dry cleaning machine, the detergent contamination, after the filtering tank, can be detected by the second detector mounted there. In the other word, when the detergent contamination after the filtering tank increasing, it makes definition of some damages in the filter occurred and supplying the detergent from the filtering tank to the washing tank can be stopped and then contaminating the washing conversely by washing can be prevented.

Advantageously, the all dry cleaning machines mention above, wherein the detector for detergent contamination level is of an image processing means, such a CCD camera or the like, to sense the detergent contamination level.

In these all dry cleaning machines, as the detector for detergent contamination is a CCD camera, it cannot sense only the detergent contamination but also a lot of waste threads mixed in the detergent. Therefore, it can prevent rapid clogging up the filtering tank.

In order to attain the objects, according to an aspect of this invention, there is provided a method of dry cleaning comprising the steps of supplying the washing and detergent to wash the washing in a washing tank, detecting detergent contamination level just after washing while treating used detergent in a filtering tank and reusing the detergent in the washing tank and shutting the detergent supply to the filtering tank and supplying fresh detergent to the washing tank to prevent the detergent contamination level is over prescribed threshold level when the detergent contamination level reaches prescribed threshold level.

In this cleaning method, contaminating the washing conversely by washing can be prevented as detecting the detergent contamination level discharged from the washing tank during washing. Then, the detergent can be used by circulating and also reused by distiller.

Advantageously, the cleaning method mentioned above, wherein the contamination level of detergent, supplied from the filtering tank to the washing tank, is detected and above channel from the filtering tank to the washing tank is closed to shut the detergent supply when the contamination level indicates an abnormal value.

In the cleaning method, contaminating the washing conversely by washing can be prevented and also the filtering tank damage can be detected because contamination level of the detergent transmitted from the filtering tank to the washing tank is detected. As a matter of course, when detecting rapidly increased contamination of the detergent, it is defined to occur some damages on the filter and then indicating or warning of the filter damage can urge to replace filter of the filtering tank.

EFFECT OF INVENTION

As mentioned above, according to this invention, the dry cleaning machine detects detergent contamination discharged from a washing tank then if the contamination level goes over prescribed value, stores the contaminated detergent in a contaminated detergent tank temporarily and supplies fresh detergent to the washing tank to prevent contaminating the washing conversely by washing. Therefore, the dry cleaning machine can use circulating detergent and clean the washing to supply clean detergent always not contaminating the washing to the washing tank.

According to this invention, the dry cleaning machine can prevent to contaminate the washing conversely by washing as cutting off the line to supply detergent from a filtering tank to a washing tank and supplying fresh detergent to the washing tank when detecting the contamination of detergent supplied from the filtering tank to the washing tank. Then, this is an excellent hygienic cleaning method.

According to this invention, the dry cleaning machine can detect reducing the light transmittance caused by darkened detergent with contamination as taking images of the detergent discharged from the washing tank by CCD camera. Moreover, advantageously the dry cleaning machine can prevent immoderate clogging of the filtering tank as judging abnormal condition by processing the image data even if a lot of waste thread or down mix into the detergent.

DESCRIPTION OF THE PREFERRED EMBODIMENTS

Some embodiments of dry cleaning machines and cleaning methods according to this invention will now be described with reference to the attached drawings.

Figure 1:
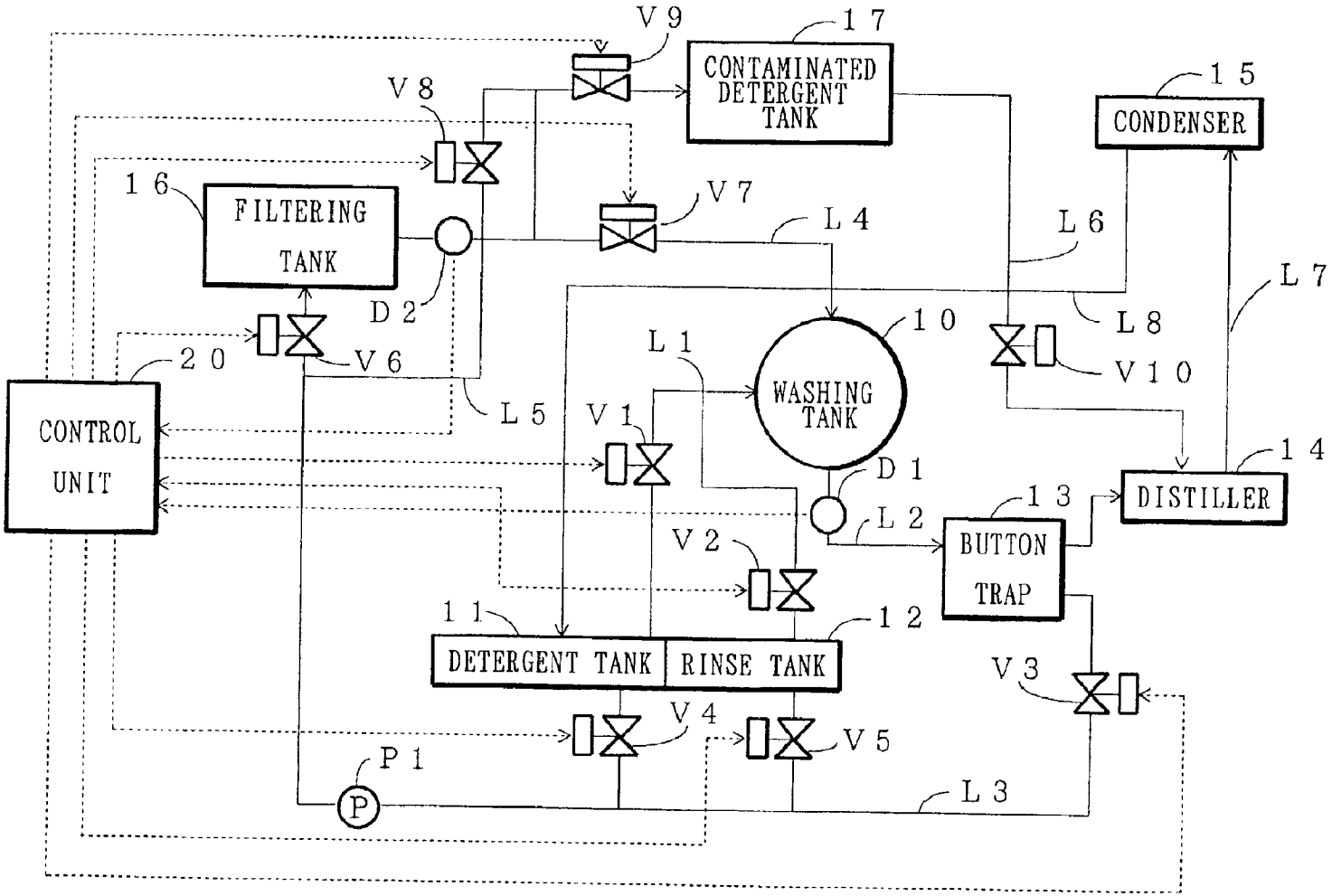
FIG. 1 is a constitutional block diagram, showing one embodiment of a dry cleaning machine according to this invention.

FIG. 1 is showing a block diagram of one embodiment of a dry cleaning machine according to this invention. In FIG. 1, a washing tank 10 is a shower drum type for washing the washing and preferably soaking type, shower type or jet type is effective and also combination type of these types is effective. A detergent tank 11 stores detergent and a rinse tank 12 stores rinse. Washing is done after inputting the washing and detergent (tetrachloroethylene or the like) into the washing tank 10. The detergent for initial use can be supplied directly through fresh detergent line L1 to the washing tank 10 or can also be supplied through circulating line L3, L4.

The detergent, discharged from the washing tank 10, is sent by pressure to the filtering tank 16 through a detergent discharging line L2, next a button trap 13 and next a circulating line L3 having a circulation pump P1 in the line. The detergent after the filtering tank 16 is supplied to the washing tank 10 through a circulating line 4. The detergent, discharged from the washing tank 10, is monitored on contamination level by a contamination detector D1, mounted in the detergent discharging line L2. The detergent, supplied from the filtering tank 16 to the washing tank 10, is monitored by a contamination detector D2, mounted in the circulating line L4. By way of the contamination detectors D1, D2, a CCD camera, a couple of light emitting elements and light receiving elements or a module of reflective millers and a couple of light emitting elements and light receiving elements or the like is used.

This dry cleaning machine includes of a distiller 14 for distilling contaminated detergent to reuse the detergent, a condenser 15 for condensing gas vaporized in the distiller 14 and a contaminated detergent tank 17 for storing the contaminated detergent temporarily. The detergent to the distiller 14 is supplied through the button strap 13 or the contaminated detergent tank 17.

Switch valves V3, V6 are mounted in the circulating line L3, wherein a contaminated detergent returning line L5 is branched off. The contaminated detergent returning line L5, wherein switching valves V8, V9 are mounted, is connected to the contaminated detergent tank 17. The contaminated detergent tank 17 is connected to the distiller 14 by the contaminated detergent returning line L6, wherein a switching valve V10 is mounted. Furthermore, the distiller 14 is connected to the condenser 15 by a vaporized gas sending line L7. The condenser 15 is connected to the detergent tank 11 by a condensed liquid sending line L8, for supplying condensed and liquefied detergent in the condenser 15 to the detergent tank 11.

A control unit 20 including CPU, provided in the dry cleaning machine, receives data output from the contamination detectors D1, D2 and controls the switching valves V1 to V10 with processing the data from the contamination detectors D1, D2.

Figure 2A:
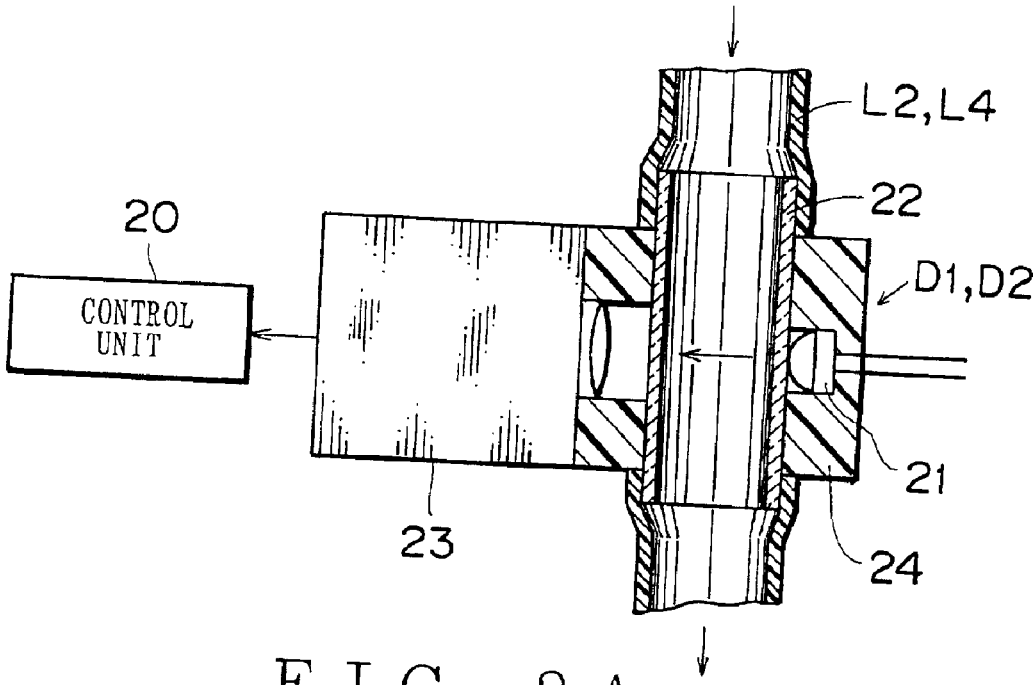
FIGS. 2A, 2B are sectional views of examples of contamination detectors.

In the next, the contamination detectors D1, D2 will be described with reference to FIGS. 2A and 2B. As the contamination detectors D1 D2 have the same structure, only the contamination detector D1 will be described herein. In FIG. 2A, the contamination detector D1 is mounted in the detergent discharging line L2 or the circulating line L4. A CCD camera 23 and a light emitting element 21, as the contamination detector D2, are placed opposite to each other sandwiching a transparent pipe 22 in the middle. The light emitting element 21, the transparent pipe 22 and the light receiving section of the CCD camera 23 are covered with a shade material 24 to cut off external light into the transparent pipe 22. Further, in FIG. 2B, the contamination detector D1 is mounted in the detergent discharging line L2 or the circulating line L4. The light emitting element 21 and a light receiving element 25, as the contamination detector D1, are placed opposite to each other sandwiching a transparent pipe 22 in the middle. The light emitting element 21, the transparent pipe 22 and the light receiving element 25 are covered with a shade material 24 to cut off external light into the transparent pipe 22. The contamination detector D1 is mounted by connecting the detergent discharging line L2 or the circulating line L4 on the both end of the contamination detector D1.

Preferably, the light emitting element 21 is placed at the same side of the CCD camera 23 or the light receiving element 25 to detect the detergent contamination by taking a image of the reflective light or receiving the reflective light, instead of placing the light emitting element 21 opposite to the CCD camera 23 or the light receiving element 25.

In the next, working of the contamination detectors D1, D2 in FIG. 2A will be described with reference to FIGS. 1, 2A. The light, radiated from the light emitting element 21, irradiates the detergent flowing in the transparent pipe 22 through the transparent pipe 22. The light, passing the detergent, is sensed by the CCD camera 23. The image data from the CCD camera 23 is inputted to the control unit 20 and judged whether over or under the prescribed threshold level on each pixel. The image data on each pixel is defined as digital signal "1" for over the prescribed threshold level and digital signal "0" for under the prescribed threshold level. And then, judgement whether over the threshold level or not is done by total sum of all digital signals of each pixel of the image and defines "1" for over the threshold level and "0" for under the threshold level. When the judgement of total sum is "1", the detergent contamination is defined to reaches the prescribed level. Thus, as the detergent contamination is defined numerically and the contamination is detected by total sum of each pixel digital signals, on the situation of detergent contamination mixed with a lot of waste thread or down waste the detection can be done.

The contamination detectors D1, D2 in FIG. 2B will be described here. The contamination detectors D1, D2 are mounted in the detergent discharging line L2 or the circulating line L4. The light from the light emitting element 21 is received by the light receiving element 25 through the transparent pipe 22. The output of the light receiving element 25 depends on light transmittance changing caused by the detergent contamination level and indicates the smaller transmitted light power the more detergent contamination. Then, the control unit 20 judges "1" by output from the contamination detectors D1, D2 when the output of the light receiving element 25 reaches the prescribed level.

Figure 2B:
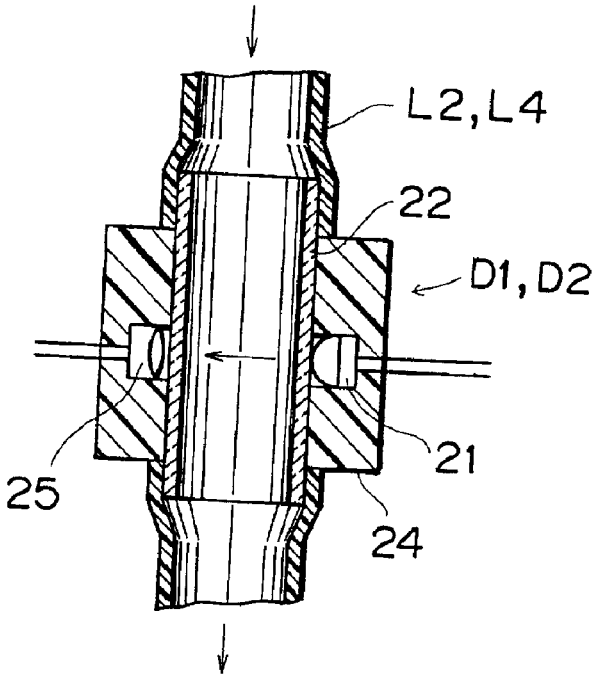

If the contamination detectors D1, D2 in FIG. 2B are mounted in the circulation line L4, it can detect to supply the contaminated detergent to the washing tank 10 or can judge to occur the filter damage in the filtering tank 16. Setting low detecting level (threshold level) for detergent contamination, damage of the filtering tank can be detected earlier and contaminating the washing conversely by washing can be solved. Preferably, inputting the output of the contamination detector D2 into the control unit 20 and monitoring time-dependent change of detergent contamination change, the filter damage of the filtering tank 16 can be detected by rapid change of the detergent contamination.

Figure 3:
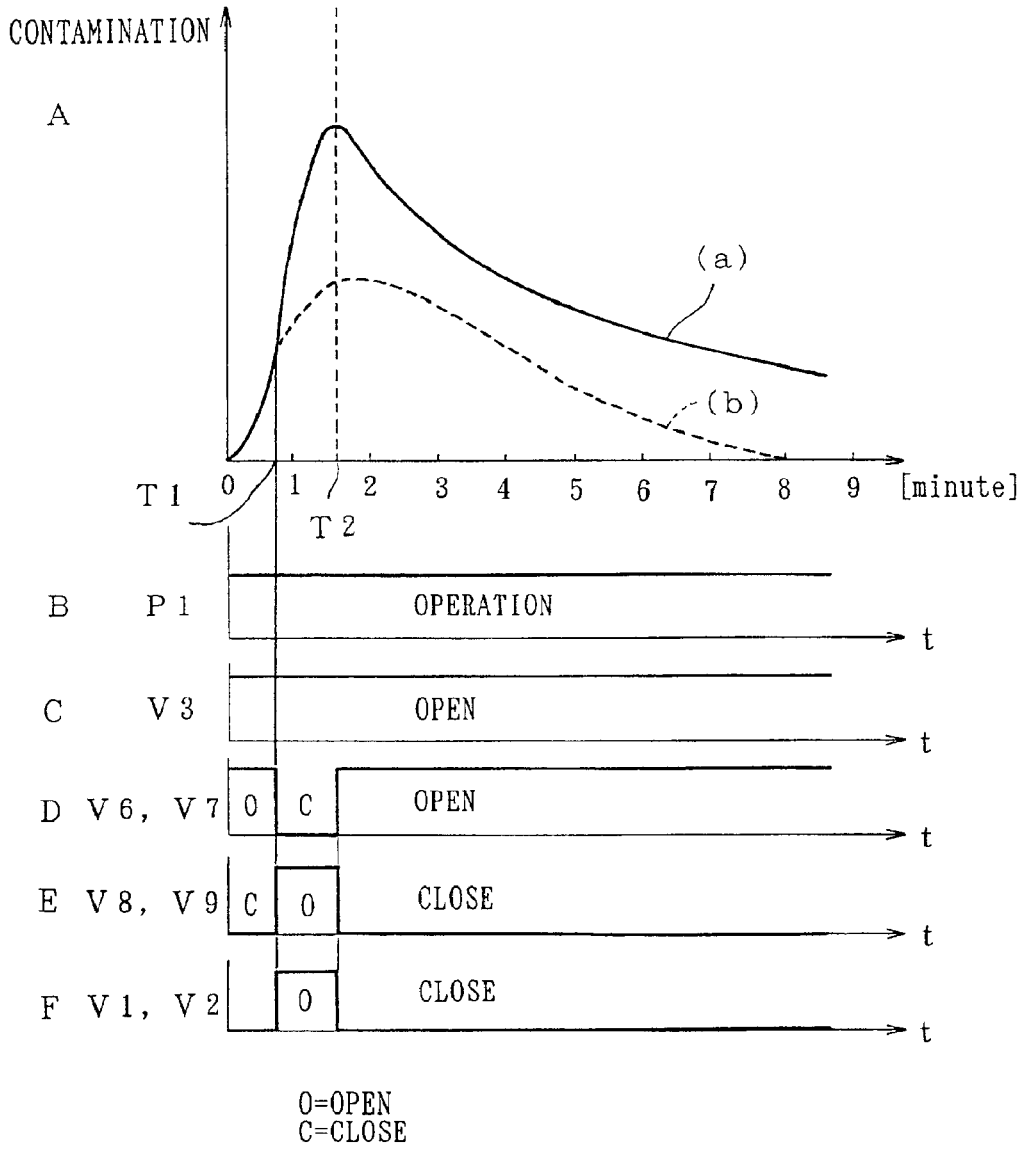
FIG. 3 is a graph and timing charts to explain the cleaning method which prevents contaminating the washing conversely by washing to detect detergent contamination in a dry cleaning machine according to this invention.

In the next, a dry cleaning method to prevent contaminating the washing conversely by washing in a dry cleaning machine according to this invention will be described with reference to FIGS. 1, 3 and 4. In FIG. 3-A shows washing property curves (a), (b) and FIG. 3-B shows working condition of the circulating pump P1 and FIGS. 3-C, D, E and F show each working condition of switching valves V3, V6 and V7, V8 and V9, V2 and V2.

On this embodiment of dry cleaning machines, the switching valves V3, V6, V7 are opened and the switching valves V8, V9 are closed in starting operation. As the switching valves V4, V5 are opened in certain level, the detergent and rinse are mixed to be usable. The mixed detergent is supplied from the filtering tank 16 to the washing tank 10 through the circulating line L3 by operating the circulating pump P1. By rotating the drum of the washing tank 10, washing the washing is started. The contamination level of the detergent, discharged from the washing tank 10, is detected by the contamination detector D1. The output of the contamination detector D1 is inputted into the control unit 20. As shown in FIG. 3-A, the property shows the detergent contamination becomes the maximum in a short time (time T2) after starting washing. Therefore, eliminating the maximum peak, when the output of the contamination detector D1 goes over the prescribed threshold level (time T1), the switching valves V6, V7 are closed as shown in FIG. 3D to cut off the circulating line L3 from the washing tank 10 to the filtering tank 16 and the circulating line L4 from the filtering tank 16 to the washing tank 10. In the other hand, the switching valves V8, V9 in the detergent returning line L5 are opened as shown in FIG. 3-E.

In the next, when the switching valves V6, V7 are closed and the switching valves V8, V9 in the contaminated detergent return line L5 are opened, the contaminated detergent is supplied to the contaminated detergent tank 17 through the contaminated detergent return line L5. In the meantime, the switching valves V1, V2 is opened and detergent, mixed by the detergent and rinse from the detergent tank 11 and the rinse tank 12, is supplied directly to the washing tank and the washing is washed. After passing the prescribed time (the time between T1 and T2 in FIG. 3-A is required time that detergent contamination is changing from the prescribed threshold level to the maximum), the switching valves V6, V7 are opened and the switching vales V8, V9 and V1, V2 are closed. Then the initial condition is set again. The contaminated detergent, sent to the contaminated detergent tank 17, is forwarded at suitable intervals to the distiller 14 through the contaminated detergent return line L6. The contaminated detergent is heated and vaporized in the distiller 14 and the vaporized gas of the contaminated detergent is forwarded to the condenser 15 to be condensed and liquefied by chiller water. The liquefied detergent is sent to the detergent tank 11 through the condensed detergent transport line L8.

Thus, the control unit 20 can improve the washing property like Washing property curve as shown in FIG. 3-B, for supplying fresh detergent directly to the washing tank by controlling each switching vales, sending control signals to each switching valve before the detergent contamination becomes the maximum. Then, contaminating the washing conversely by washing can be solved and cyclically use of the detergent can be worked.

In the next, prevention to contaminate the washing conversely caused by filer damage of the filtering tank in a dry cleaning machine will be described with reference to FIG. 4. The curve (b) in FIG. 4-A shows the washing property curve by the operation method to prevent above conversely contamination. The curve (c) in FIG. 4-A shows contaminated detergent leaking when the filter of the filtering tank is damaged. Solving to contaminate the washing conversely by such filter damage, the contamination detector D2 is mounted in the circulating line L4 from the filtering tank 16 to the washing tank 10.

The contamination detector D2 is detecting the contamination level of detergent flowing in the circulating line L4. When the output of the contamination detector D2 is over the prescribed threshold level (in the condition as shown in FIGS. 4-A, C), the switching valve V7 is closed and the switching valve V9 is opened as shown in FIGS. 4-D, F. Then, the detergent passed through the filtering tank 16 is sent to the contaminated detergent tank 17. In the meantime, the switching valves V1, V2 are opened as shown in FIG. 4-G and fresh detergent is supplied to the washing tank 10 through fresh detergent line L1 and this condition is kept until washing finished. The switching valves V6, V8 are kept as shown in FIGS. 4-C, E. The contamination level of the detergent, discharged from the washing tank 10, is detected by the contamination detector D1 as shown in FIG. 3-A. When the detergent contamination level is over the prescribed threshold level, the switching valves V6, V7 is closed to cut off the circulating line L4 from the washing tank 10 to the filtering tank 16 and the switching valves V8, V9, mounted in the contaminated detergent return line L5, are opened to send the contaminated detergent to the contaminated detergent tank 17.

On the other hand, the switching valve V10, mounted in the contaminated detergent return line L6, is opened and the contaminated detergent in the contaminated detergent tank 17 is forwarded to the distiller 14. The vaporized gas by heating and vaporizing the contaminated detergent in the distiller 14 is sent through the vaporized gas transport line L7 to the condenser 15 to be condensed and liquefied by chiller water. The liquefied detergent is returned to the detergent tank 11 through the condensed detergent transport line L8.

Figure 4:
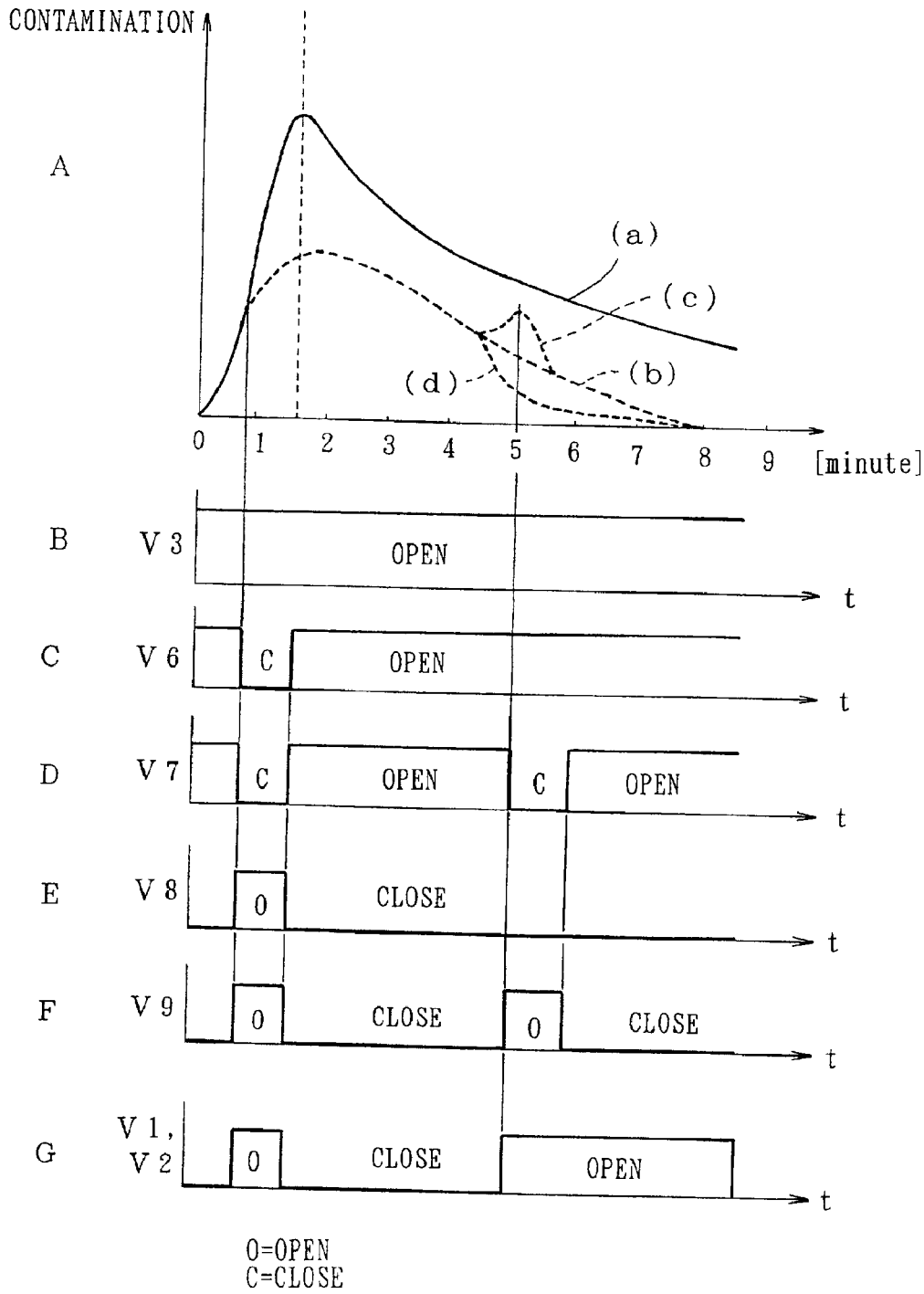
FIG. 4 is a graph and timing charts to explain the cleaning method which prevents contaminating the washing conversely by washing to detect detergent contamination supplied from the filtering tank in a dry cleaning machine according to this invention.
Figure 5:
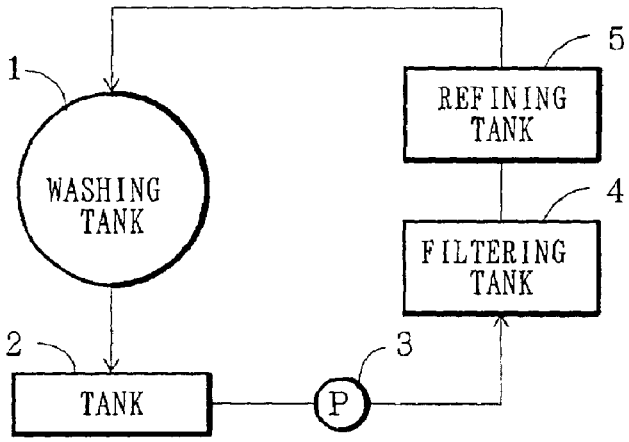
PRIOR ART FIG. 5
FIG. 5 is a block diagram to explain a dry cleaning machine by prior art.
Figure 6:
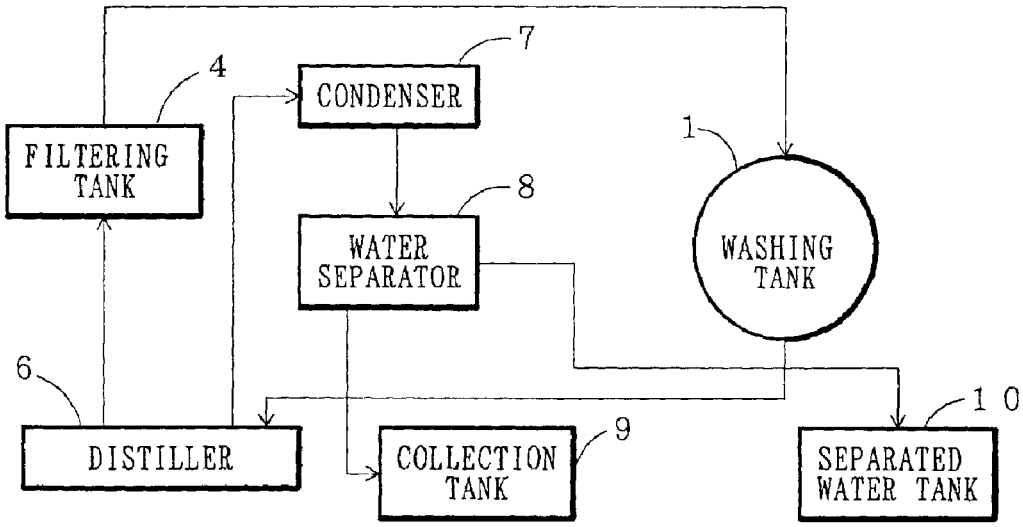
PRIOR ART FIG. 6
FIG. 6 is a block diagram to explain a dry cleaning machine by prior art.
Figure 7:
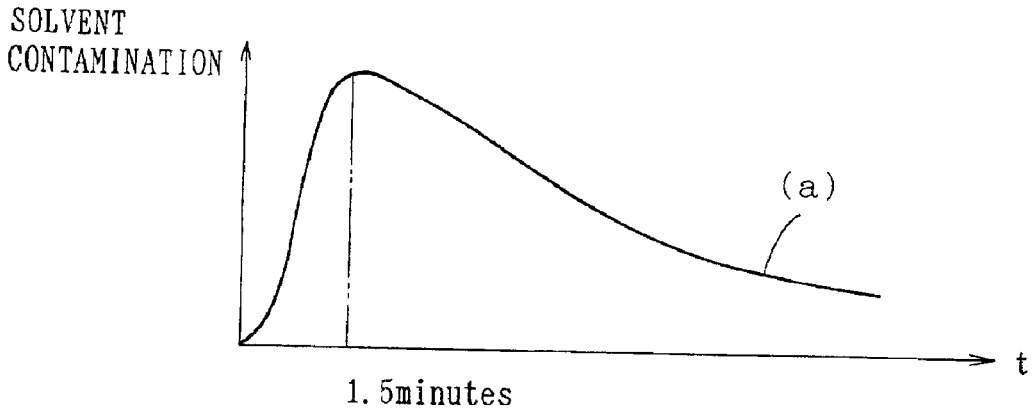
FIG. 7 is a graph to explain washing property of a dry cleaning machine.

Detecting the contamination of the detergent from the filtering tank 16 and controlling as mentioned above can give the washing property as shown in FIG. 4-D. In addition, as the filter in the filtering tank 16 can be exchanged after washing the washing finished, the maintenance of the filtering tank is made easy. Preferably, in case of detecting abnormal condition by the contamination detector D2, indicating or alarming filter damage, then stopping operation temporarily, then exchanging filter in the filtering tank 16, then restarting operation is effective.

Preferably, instead of detecting the detergent contamination by inputting image data by a CCD camera continuously to the control unit, detecting both of image data by a CCD camera and output signal by a light receiving element and inputting the data and the signal to the control unit to sense the detergent contamination is also effective.

Advantageously, a dry cleaning machine having only one contamination detector D1 can solve issue to contaminate the washing conversely by washing. Mounting the second contamination detector D2 in the dry cleaning machine can prevent more effectively contaminating the washing conversely by washing.

What is claimed is:

1. In a dry cleaning machine including a detergent tank to store detergent, a washing tank and a filtering tank to treat used detergent, wherein the treated detergent is sent back to the washing tank for cyclical use, the dry cleaning machine comprising:

detecting means for detecting contamination level of the detergent discharged from the washing tank while washing;

storing means for storing the used detergent when the contamination level of detergent reaches prescribed threshold level; and distilling means for distilling the used detergent, whereby fresh detergent is supplied from the detergent tank to the washing tank.

2. The dry cleaning machine according to claim 1, further comprising a channel connecting the filtering tank to the washing tank which channel is closed when a contamination level indicates in the channel indicates an abnormal value, and the detergent from the filtering tank is stored temporarily and distilled by the distilling means.

3. The dry cleaning machine according to claim 1, wherein the detecting means for detecting detergent contamination level is of an image processing means, such as a CCD camera or the like.

4. The dry cleaning machine according to claim 2, wherein the detecting means for detecting detergent contamination level is of an image processing means, such as a CCD camera or the like.

5. A dry cleaning machine, comprising:

a washing tank for washing by detergent supplied from a detergent tank;

a fitering tank for refining contaminated detergent discharged from the washing tank and supplying the refined detergent to the washing tank;

a contamination detector for detecting contamination level of detergent after used in the washing tank;

a contaminated detergent tank for storing contaminated detergent temporarily while shutting detergent supplying channel from the washing tank to the filtering tank when the contamination level is over prescribed threshold level;

a distiller to distill the contaminated detergent from the contaminated detergent tank; and a condenser for condensing vaporized contaminated detergent in the distiller and sending the condensed detergent to the detergent tank.

6. The dry cleaning machine according to claim 5, wherein a second detector is mounted in a channel to supply detergent from the filtering tank to the washing tank for detecting the detergent contamination level in the channel.

7. The dry cleaning machine according to claim 5, wherein the contamination detector for detecting detergent contamination level is of an image processing means, such as a CCD camera or the like.

8. The dry cleaning machine according to claim 6, wherein the contamination detector for detecting detergent contamination level is of an image processing means, such as a CCD camera or the like.

* * * * *